United States Patent [19]

Frenkel

[11] 4,068,562

[45] Jan. 17, 1978

[54] CYLINDER OF PISTON COMPRESSOR

[76] Inventor: Mark Isaakovich Frenkel, ulitsa Karbysheva, 6, korpus 2, kv. 20, Leningrad, U.S.S.R.

[21] Appl. No.: 426,242

[22] Filed: Dec. 19, 1973

[51] Int. Cl.[2] ..... F01B 31/14

[52] U.S. Cl. ..... 92/60.5; 417/275; 417/310

[58] Field of Search ..... 417/274, 275, 567, 307; 137/516.15; 92/60.5

[56] References Cited

U.S. PATENT DOCUMENTS

| | | | |
|---|---|---|---|
| 1,740,967 | 12/1929 | Buehler | 92/60.5 |
| 2,047,167 | 7/1936 | Heller | 417/274 |
| 3,045,892 | 7/1962 | White | 417/274 |
| 3,159,330 | 12/1964 | Boldt | 92/60.5 |
| 3,354,790 | 11/1967 | Race | 92/60.5 |
| 3,786,833 | 1/1974 | Frenkel | 137/512.15 |
| 3,823,735 | 7/1974 | Frenkel | 137/512.15 |

FOREIGN PATENT DOCUMENTS

| | | | |
|---|---|---|---|
| 682,618 | 3/1964 | Canada | 137/512.15 |

*Primary Examiner*—William L. Freeh
*Assistant Examiner*—Edward Look
*Attorney, Agent, or Firm*—Haseltine, Lake & Waters

[57] ABSTRACT

A cylinder of a piston compressor comprises a piston movable along the axis of the cylinder, a cylindrical admission valve and a cylindrical delivery valve. The admission valve communicates an admission space of the cylinder with a working space thereof. The delivery valve communicates the working space of the cylinder with a delivery space thereof.

At least one valve, for instance the admission valve has means providing the control of the capacity of the cylinder, the movable member of said means being coaxially arranged inside the cylindrical admission valve.

6 Claims, 3 Drawing Figures

CYLINDER OF PISTON COMPRESSOR

The present invention relates to the manufacture of a compressor, and more specifically to the cylinder of a piston compressor.

The present invention may be the most advantageously used in compressors in order to provide either the effective stepless or stepwise control over their respective capacity, for particular use in the chemical industry, such as in the production of nitrogenous fertilizers or methanol, in the gas recovery and processing industry, for instance in gas conveyance, as well as in power production for auxiliary pneumatic installations.

Known in the art is a cylinder for a piston compressor which comprises a piston axially movable within the cylinder, and cylindrical admission and delivery valves. The admission valve communicates an inlet space of the cylinder with a working space thereof, and is essentially a non-return valve. This admission valve will open the passage for fluid being compressed only in the direction of the admission into the working space of the cylinder. The delivery valve communicates a delivery space in the cylinder with the working space thereof, and being essentially a non-return valve, the delivery valve will open the passage for the compressed fluid in the direction from the working space of the cylinder towards the delivery space. The cylindrical valve comprises a set or pack of alternating annular elastic laminae and rigid annular valve seats having radially extending passages for passing fluid being compressed. These elements are known in the art and are fully described in applicants' U.S. Pat. No. 3,786,833; issued Jan. 22, 1974. The space enclosed by the cylindrical valve is partially occupied by a displacement cone. The latter is adapted for reducing the volume of the main "dead space" of the cylinder. The cylinder of the piston compressor is also provided with means for controlling its capacity, which are widely known. In some cases this means is adapted for effecting the stepwise control of the cylinder capacity and may comprise a constant-volume chamber having a cavity communicating with the working space of the cylinder through the intermediary of a connector valve. Upon the opening of the connector valve, the interior of the chamber is communicated with the volume of the working space of the cylinder, thereby increasing the main "dead space" of the cylinder by the volume of the chamber the latter of which constitutes an additional "dead space." Upon the compression of the fluid being compressed in the working space of the cylinder, a part of the fluid flows into the chamber through the connector valve while, during the expansion of the fluid which is being compressed, the fluid being compressed is returned from the chamber into the working space of the cylinder so as to, thereby reduce the volume of the admitted fluid which is being compressed. The reduction of the volume of the admitted fluid being compressed results in a stepwise change in the compressor capacity.

In other cases this means is adapted for the stepless control of the cylinder capacity. In this case, this means comprises a variable-volume chamber and is made in the form a cylinder having a piston axially movable therein. The cavity of the cylinder communicates with the compressor cylinder cavity and serves as an additional "dead space." During the displacement of the piston within the cylinder, which constitutes means for controlling the capacity of the compressor cylinder, the additional "dead space" is varied in volume, so as to effect the stepless control of the capacity of the cylinder of a piston compressor.

Abrupt changes in the capacity of the compressor cylinder may also be effected by using a by-pass valve which communicates the working space of the compressor cylinder with the admission or inlet space thereof. Upon the opening of the by-pass valve, the fluid being compressed, which has entered the working space of the cylinder through the annular admission valve, can freely flow from the working space of the cylinder into the admission space without being compressed. Thus, the fluid being compressed leaves the working space of the cylinder during the entire period of the piston movement in a direction which is opposite to the direction of the piston movement during the admission stroke. Therefore, the by-pass valve will ensure an abrupt change in the capacity of the compressor cylinder from its full capacity down to zero, in essence until the full interruption of flow of the delivery of the fluid which is being compressed from the working space of the cylinder into the delivery space of the latter.

The disadvantage of presently known cylinder for a piston compressor consists of in that its is required to also provide, in addition to the admission and delivery valves mounted on the cylinder, connector valves which communicate the working space of the cylinder with the constant-volume chamber or with the admission chamber of the cylinder. This not only complicates the cylinder structure, but in some cases renders it difficult to provide space for such valves. Therefore, the size of the admission, delivery and connector must be reduced resulting in elevated dynamic energy losses, or the valves are arranged in a staggered pattern by shifting them relative to the cylinder axis so that the cylinder size is increased with an increase in the "dead space" of the compressor cylinder, whereby the volumetric efficiency of the cylinder becomes lower. The reduction of the volumetric efficiency of the cylinder adversely affects the economic performance of the compressor and results in a need for increasing the cylinder size.

It is an object of the invention to improve the effectiveness of a piston compressor due to a reduction in the dynamic energy losses and cylinder size.

It is another object of the invention to simplify the structure of the compressor cylinder.

In accordance with the above and other objects, the invention consists of in that in a cylinder of a piston compressor comprises an axially movable piston, cylindrical admission valves each communicating an admission space of the cylinder with a working space thereof, and a set of alternating annular elastic notched laminae and rigid annular seats having radially extending passages for passing fluid being compressed, cylindrical delivery valves each communicating a delivery space of the cylinder with the working space thereof, and a set or pack of alternating annular elastic notched laminae and rigid annular seats having radially extending passages for passing the compressed fluid. According to the invention, at least one cylindrical valve is provided with means which are known per se for controlling the capacity of the cylinder, with the means having an axially movable member coaxially arranged within the cylindrical valve.

By means of this embodiment, the piston compressor cylinder has a reduced "dead space," since the cavity of the cylindrical valve is used as a passage communicating means for controlling the cylinder capacity with the working space of the cylinder. The reduction of the "dead space," as is known, improves the effectiveness of the compressor and results in a reduced size for the cylinder while concurrently simplifying the structure of the cylinder.

Suitable arrangement of means for controlling the capacity of the cylinder and the cylindrical valve, that is the accommodation of means for controlling the capacity of the cylinder inside the cylindrical valve enables the reduction of the cylinder size and permits mounting on the cylinder of the admission and delivery valves so as to provide a larger free passage area, thereby reducing the dynamic energy losses in the cylinder and consequently improving the effectiveness of the cylinder and the compressor as a whole.

Each movable member is, preferably, made in the form of a by-pass valve communicating the working space of the cylinder with a chamber whose cavity is used as an additional "dead space" having a constant volume.

This embodiment of the movable member ensures the stepwise control of the compressor capacity without appreciably increasing the main "dead space" of the cylinder, since a passage communicating the chamber with the working space of the cylinder, in this case, comprises the cavity of the cylindrical valve so as to result in a reduced size for the cylinder.

The movable member is preferably made as a piston, the displacement of the piston thus freeing the space which constitutes the variable "dead space."

This embodiment of the movable member enables effecting of the stepless control of the cylinder capacity. During the controlling of the cylinder capacity, when the piston is retracted from the cylindrical valve, the free passage area of the cylindrical valve passage is increased, so as to reduce the dynamic energy losses in the cylinder. This results in a more effective operation of the compressor.

The movable member is preferably made as a valve communicating the admission space of the cylinder with the working space thereof.

This embodiment of the movable member enables the stepwise control of the cylinder capacity.

The accommodation of the valve within the cylindrical valve makes it possible to have a free passage area for the valve which is greater or equal to the cross-sectional area of the cavity of the cylindrical valve, so as to appreciably reduce the dynamic losses during the controlling of the cylinder capacity, while during the operation of the cylinder at full capacity there is substantially no increase in the main "dead space." Therefore, the operation of the compressor without control is more effective, and the dynamic energy losses are reduced in the control mode of operation.

Other objects and advantages of the invention will become more apparent from the following description of specific embodiments thereof with reference to the accompanying drawings, in which.

Figure 1:
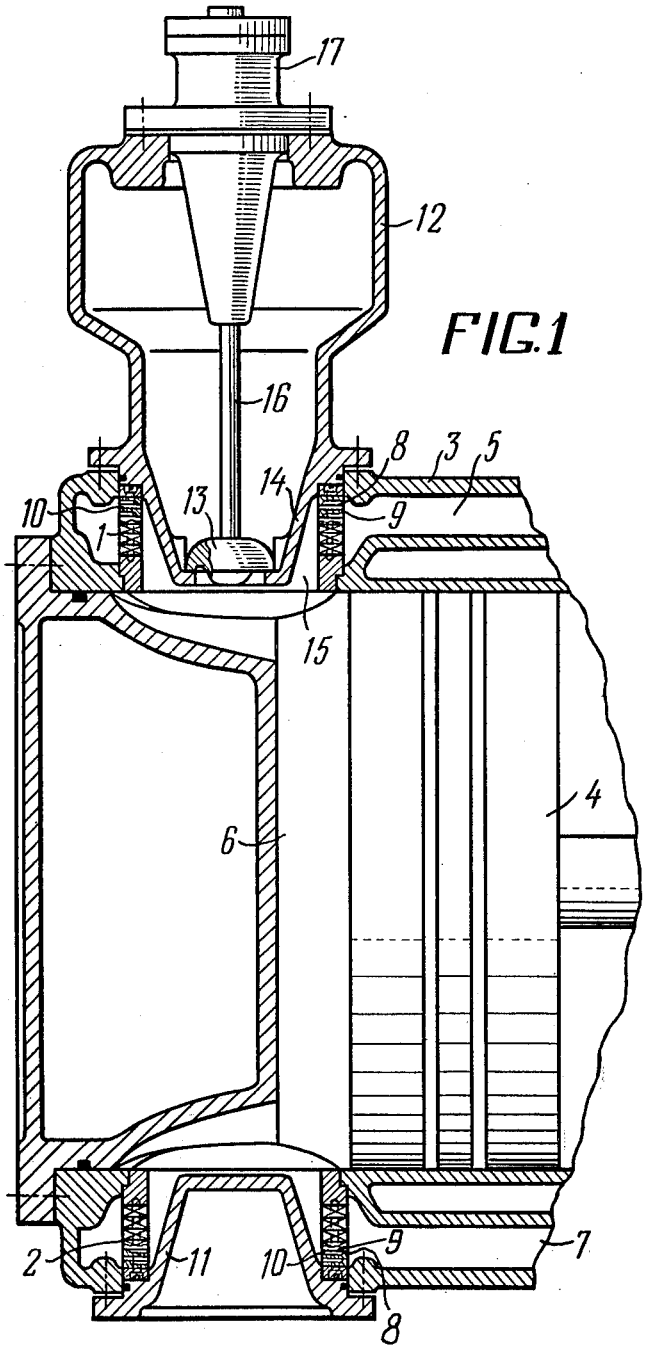
FIG. 1 is a diagrammatic view of a longitudinal section of a cylinder for a piston compressor having means providing the stepwise control of the capacity thereof, according to the invention.

The cylinder of a piston compressor comprises cylindrical admission valve 1 (FIG. 1) and a cylindrical delivery valve 2. A piston 4 is axially movable in a body 3 of the cylinder.

The admission valve 1 communicates an admission space 5 of the cylinder with a working space 6 thereof, and the delivery valve 2 communicates the working space 6 with a delivery space 7 of the cylinder. Each of the cylindrical valves 1 and 2 comprises a set of alternating annular elastic notched laminae 8 and rigid annular seats 9 which have passages 10 for passing gas. These are shown and described in applicants U.S. Pat. No. 3,786,833. The delivery valve 2 is provided with a displacement cone 11.

The cylindrical admission valve 1 is provided with means for controlling the cylinder capacity. Means for controlling the cylinder capacity in he stepwise manner includes a chamber 12 having a cavity which defines an additional "dead space" of constant volume. The chamber 12 communicates with the working space 6 of the cylinder by means of a by-pass valve 13 which has large free passage area.

The by-pass valve 13 is accommodated within a tapered portion 14 of the chamber 12, while the tapered portion 14 of the chamber 12 is located within the cavity 15 of the cylindrical admission valve 1.

The displacement of a rod 16 of the by-pass valve 13 is effected manually or by means of an actuating mechanism 17.

The cylinder of the piston compressor operates as follows.

During the stroke of the piston 4, corresponding to the increase in the volume of the working space 6 of the cylinder gas, pressure in the working space 6 decreases, and the admission valve 1 opens under the action of a pressure differential between the admission space 5 and the working space 6 of the cylinder so that the gas flows from the admission space 5 into the working space 6 of the cylinder. At the beginning of movement of the piston 4 in the opposite direction, the compression of gas takes place in the working space 6 of the cylinder, and when the gas pressure in this space exceeds that in the delivery space 7, the delivery valve 2 opens, and the compressed gas is expelled from the working space 6 of the cylinder into the delivery space 7.

During the controlling of the cylinder capacity, the actuating mechanism 17 will act upon the rod 16 so as to open the by-pass valve 13 and, as a result, a part of the gas will be by-passed into the chamber 12 through the valve 13 during the compression of the gas in the working space 6 of the cylinder.

During the expansion of the gas in the working space 6 of the cylinder, the gas is returned from the chamber 12 into the working space 6 of the cylinder, so as to occupy a part of its volume in order to reduce the volume gas entering the working space 6 of from the admission space 5, and thereby reducing the compressor capacity.

In order to achieve a predetermined capacity control range, to increase the number of the control steps, as well as to ensure the capability of changing the intermediate pressure values in a multi-stage compressor, means for controlling the capacity according to the invention may be mounted in several valves of one or a number of several cylinders of one or different stages.

Figure 2:
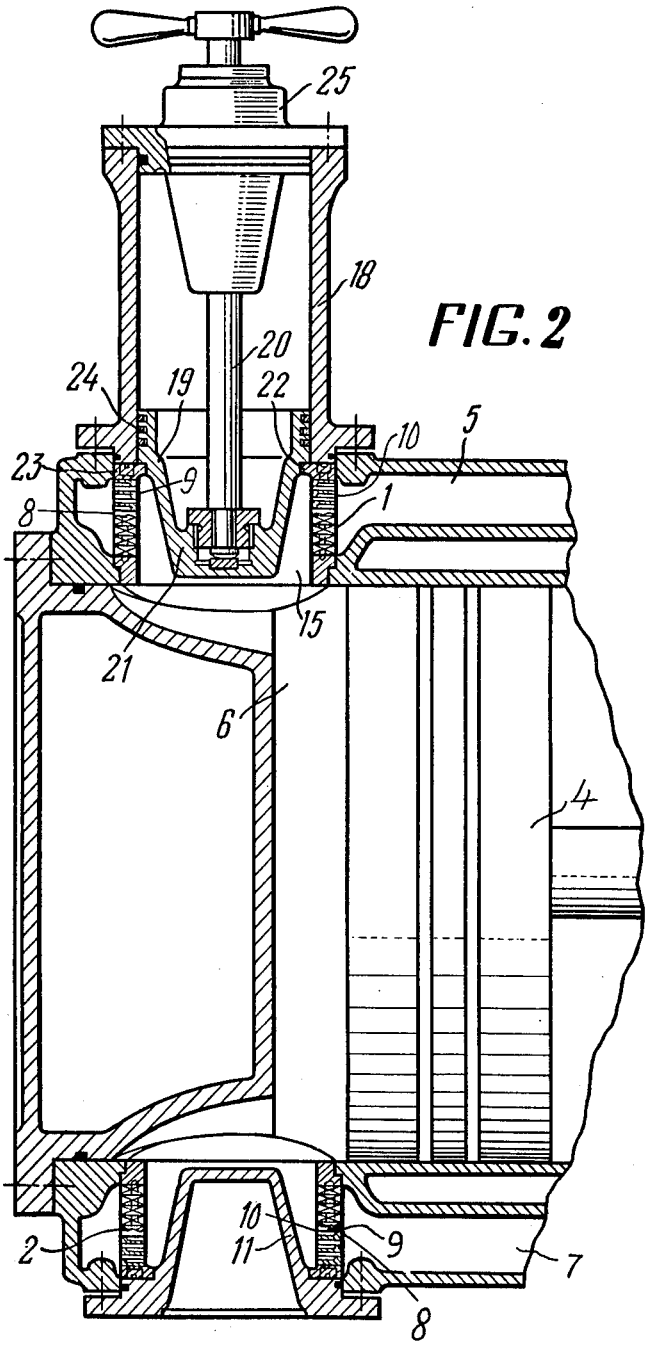
FIG. 2 is a longitudinal sectional view of a piston compressor cylinder having means providing the stepless control of the capacity thereof, according to the invention.

Means for the stepless control of the cylinder capacity comprise a cylinder 18 (FIG. 2) having a piston 19, which is axially movable therein. The piston 19 is displaced by means of a rod 20. The cylinder 18 is located immediately above the valve 1. The piston 19 is made tapered and is so arranged that, at full capacity of the compressor cylinder the piston is received with its tapered portion 21 in the cavity 15 of the cylindrical valve 1. In this position, the piston 19 is urged against an abutment shoulder 22 on a ring 23. This embodiment eliminates gas leakage through seals 24 for the piston 19. The rod 20 is displaced by means of a manually operated mechanism 25, or by an actuating mechanism.

During the controlling of the capacity of the compressor cylinder, the mechanism 25 acts upon the rod 20 so as to displace the piston 19 in such a manner whereby its tapered portion 21 leaves the cavity 15 of the cylindrical valve 1, thereby increasing the volume of a "dead space" formed in the working space 6 of the cylinder.

During the compression of gas in the working space 6 of the cylinder a part of the gas overflows into the space of the cylinder 18 which is freed by the piston 19. During the expansion of the gas in the working space 6, of the cylinder the gas returns from the cylinder 18 inti the working space 6 so as to occupy a part of its volume, thereby reducing the volume of gas entering the working space 6 from the admission chamber 5, to thereby reduce the capacity of the compressor. Since the piston 19 can be adjusted and fixed at any desired position within the cylinder 18, the variation of the capacity of the compressor cylinder is effected in the stepless manner within the range limited by the volume which is defined by the two extreme displacement positions of the piston 19.

Figure 3:
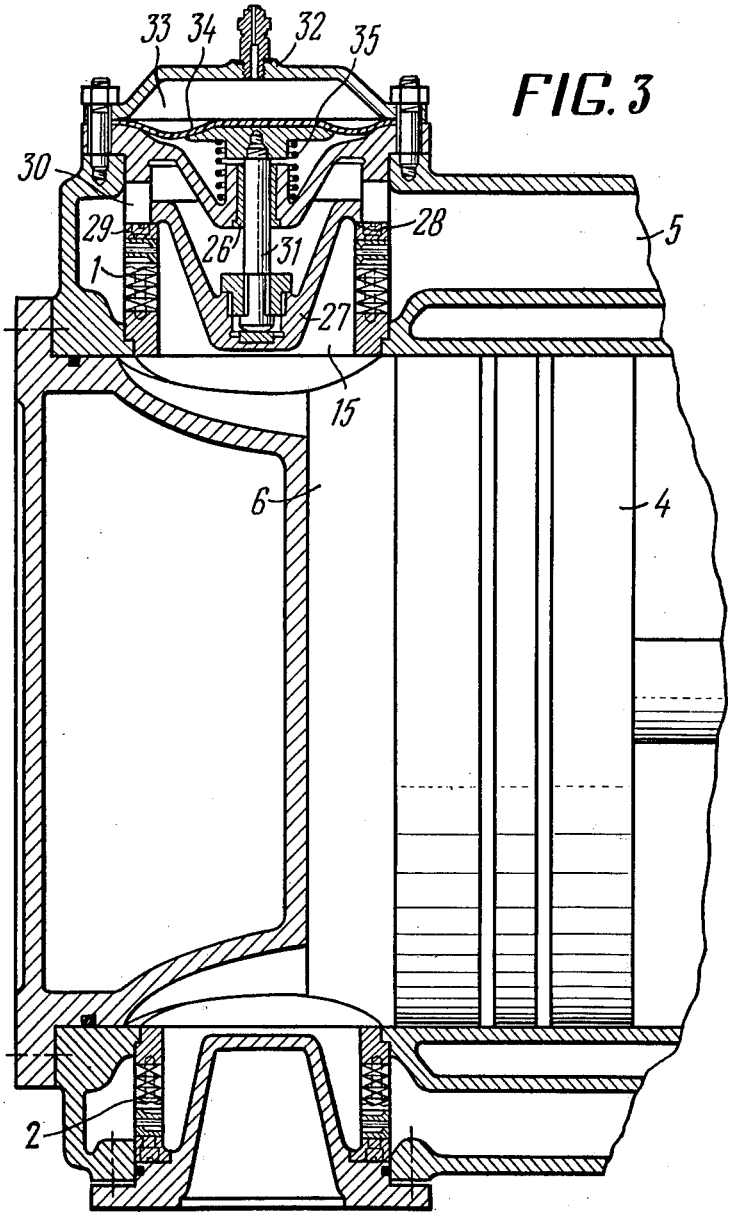
FIG. 3 is a longitudinal sectional view of a cylinder for a piston compressor having means providing the stepwise control of the capacity thereof an abrupt change from 100% capacity down to zero capacity of the working space of the cylinder, according to the invention.

Means for the stepwise control of the cylinder capacity with an abrupt change 100% capacity to zero capacity of the working space 6 comprises a by-pass valve 26 (FIG. 3) which communicates the admission space 5 of the cylinder with the working space 6 thereof.

The valve 26 is located immediately above the cylindrical valve 1 in such a manner whereby a tapered portion of its valve member 27 is received into the cavity 15 of the cylindrical valve 1, while a sealing shoulder 28 of the valve member 27 bears against a ring 29 located on the cylindrical valve 1, which functions as a seat of the valve 26. The valve 26 is provided with openings 30 adapted to by-pass the gas from the working space 6 of the cylinder into the admission space 5. The valve member 27 of the valve 26 is operatively connected to an actuating mechanism 32 by means of a rod 31 for displacement of the working member 27 of the valve 26. The air-operated actuating mechanism 32 has a chamber 33 supplied with compressed air, a diaphragm 34 and a return spring 35.

At full capacity of the compressor cylinder the chamber 33 of the actuating mechanism 32 is under pressure of compressed air which acts upon the diaphragm 34 so as to hold the valve member 27 of the valve 26 by means of the rod 31 in the closed position.

During the controlling of the compressor capacity the chamber 33 of the actuating mechanism 32 is communicated with atmosphere and the valve member 27 of the valve 26 is displaced under the action of the return spring 35 so as to communicate the working space 6 with the admission space 5 through the openings 30. In this case, during intermediary of the movement of the piston 4 corresponding to the reduction of the volume of the working chamber 6, the gas will freely flow from the working space 6 into the admission space 5 through the openings 30, the latter of which are unobstructed, whereby the compression of the gas in the working space 6 of the cylinder is completely interrupted, and the capacity of this space 6 is abruptly reduced from 100% to zero. In order to effect the reverse transition from the operation in the control mode (idle running conditions in the space 6) to operation at full capacity, air under pressure is again fed into the chamber 33 of the actuating mechanism 32 so that the openings 30 of the valve 26 are closed, while the seating of the valve member 27 against the ring 29 prevents the compressed gas from leaking through the gaps.

In order to achieve a predetermined control range and to increase the number of the capacity control steps, to reduce energy losses during the operation in the reduced capacity mode and under the idle running conditions, as well as to provide the opportunity of using control means in a multi-stage compressor without excessively changing intermediate pressure values, means for controlling the capacity according to the invention may be mounted on one or several valves of one or both cylinder spaces of diferent stages. The cylinder according to the invention may also be used in combination with means for controlling the capacity by connecting additional constant — or variable volume chambers.

What is claimed is:

1. An arrangement for controlling the capacity of a piston compressor comprising: a piston axially movable in said cylinder; an admission space in said cylinder; a working space in said cylinder, cylindrical admission valves, each communicating said admission space of said cylinder with the working space thereof; annular elastic notched laminae of each of said cylindrical admission valves; annular rigid seats of each of said cylindrical admission valves; said seats having passages for the flow of the fluid being compressed; said annular elastic notched laminae and said annular rigid seats alternating with one another; a delivery space of said cylinder; cylindrical delivery valves, each communicating said delivery space of said cylinder with said working space thereof; annular elastic notched laminae of each of said cylindrical delivery valves; annular rigid seats of each of said cylindrical delivery valves; said seats having passages for the flow of the compressed fluid, said annular elastic notched laminae and said annular rigid seats alternating with one another; a volume reducing cone adjacent to said admission valves and said delivery valves for reducing dead space in said valves; and means cooperating with one of said cones for adjusting the output of said cylinder.

2. A cylinder according to claim 1, wherein said movable member comprises a by-pass valve including a chamber whose cavity forms an additional "dead space" of a constant volume; said by-pass valve communicating said working space of said cylinder with said chamber.

3. An arrangement for controlling the capacity of a compressor according to claim 1, including a second piston which is displaceable so as to vary the space at said head end of the compressor cylinder.

4. An arrangement for controlling the capacity of a compressor according to claim 3, wherein the lower portion of said second piston defines the upper wall of said variable volume space.

5. A cylinder according to claim 1, wherein said movable member comprises a valve communicting said admission space of said cylinder with said working space thereof.

6. An arrangement for controlling the capacity of a compressor as defined in claim 1 including chamber means communicating with said working space; by-pass value means between said working space and said chamber means and controlled by said adjusting means cone for admitting fluid into said chamber means from said working space during the stroke of said piston when compressing said fluid, the fluid admitted into said chamber means being a portion of the fluid in said working space expelled through said delivery space, the fluid admitted into said chamber means bypassing said delivery space, the fluid admitted into said chamber means being returned to said working space during the expansion stroke of said piston for reducing the amount of fluid drawn into the working space through said admission valves and thereby reducing the capacity of the compressor.

* * * * *